US005783765A

United States Patent [19]

Muramatsu

[11] Patent Number: 5,783,765

[45] Date of Patent: Jul. 21, 1998

[54] KEYBOARD MUSICAL INSTRUMENT EQUIPPED WITH ELECTROMAGNETIC KEY TOUCH GENERATOR FOR IMPARTING PIANO KEY-TOUCH TO PLAYER

[75] Inventor: Shigeru Muramatsu, Shizuoka, Japan

[73] Assignee: Yamaha Corporation, Shizuoka-ken, Japan

[21] Appl. No.: 887,176

[22] Filed: Jul. 2, 1997

[51] Int. Cl.[6] ..... G10H 1/055

[52] U.S. Cl. ..... 84/615; 84/626; 84/658; 84/688; 84/690

[58] Field of Search ..... 84/615, 626, 658, 84/687–690, 20–22, 115, DIG. 7

[56] References Cited

FOREIGN PATENT DOCUMENTS 2-232691 9/1990 Japan .
4-204697 7/1992 Japan .
5-11765 1/1993 Japan .
7-111631 11/1995 Japan .

*Primary Examiner*—Stanley J. Witkowski
*Attorney, Agent, or Firm*—Ostrolenk, Faber, Gerb & Soffen, LLP

[57] ABSTRACT

A keyboard musical instrument includes an electromagnetic key touch generator for imparting a piano-like key touch to black/white keys, and the electromagnetic key touch generator has leaf spring members respectively held in contact with the upper surface of the black/white keys for urging the black/white keys toward the end positions and coil springs urging plungers of solenoid-operated key actuators to urge the black/white keys toward the rest positions; the resilient force of each leaf spring member is balanced with the resilient force of the associated coil spring at the rest position of the associated black/white key, and the solenoid-operated key actuator is expected to partially cancel the resilient force of the coil spring so as to build up resistance to the black/white key depressed by a player.

10 Claims, 4 Drawing Sheets

KEYBOARD MUSICAL INSTRUMENT EQUIPPED WITH ELECTROMAGNETIC KEY TOUCH GENERATOR FOR IMPARTING PIANO KEY-TOUCH TO PLAYER

FIELD OF THE INVENTION

This invention relates to a keyboard musical instrument and, more particularly, to a keyboard musical instrument equipped with solenoid-operated actuators for imparting piano key-touch to a player.

DESCRIPTION OF THE RELATED ART

Solenoid-operated actuators are used in a keyboard musical instrument for various purposes. A set of solenoid-operated actuators are mounted on a key bed, and selectively drives the keys for playing a tune without a fingering. Another application is to impart a piano key-touch to keys which are not linked with key action mechanisms. An electromagnetic means for imparting the piano key-touch is hereinbelow referred to as "electromagnetic key-touch generator".

The electromagnetic key touch generator is disclosed in Japanese Patent Publication of Examined Application No. 7-111631 and Japanese Patent Publication of Unexamined Application Nos. 5-11765 and 4-204697. The prior art electromagnetic key touch generator has a plunger projectable from and retractable into a solenoid, and the plunger is connected to an end portion of a turnable key forced toward the rest position by a return spring at all times. The plunger is connected to the end portion by means of a pin.

Another prior art electromagnetic key touch generator is disclosed in Japanese Patent Publication of Unexamined Application No. 2-232691. The prior art electromagnetic key touch generator is implemented by a permanent magnet and an electro-magnet. The permanent magnet is attached to a key, and the electro-magnetic is energized so that repulsion between the permanent magnet and the electro-magnet gives load to the key motion.

The first prior art electromagnetic key touch generator encounters a problem in the durability. As described hereinbefore, the plunger is connected to the end of the key by means of a pin member, and the pin member is liable to be worn away due to the friction therebetween. As a result, the joint between the key and the electromagnetic key touch generator rattles, and the loose joint is causative of malfunction. If the plunger is integrated with the key, the integrated member is free from the loose joint. However, the integrated member is not easily assembled with the other parts, and an universal join is required for the integrated member. Moreover, the solenoid-operated actuator is expected to generate large electromagnetic force against the return spring.

The second prior art electromagnetic key touch generator encounters a problem in the volume. The electro-magnet is expected to strong magnetic field so as to exert large repulsion on the permanent magnet, and the large electromagnetic force requires a large amount of current passing through the solenoid. This means that a large solenoid is required for the electro-magnet. However, the space between the key bed and the keys is so narrow that the electro-magnet is insufficiently enlarged. For this reason, the second prior art electro-magnetic key touch generator merely gives insufficient repulsion different from the piano key touch.

SUMMARY OF THE INVENTION

It is therefore an important object of the present invention to provide a simple durable electromagnetic key touch generator for imparting a key-touch like the piano key touch given by a key action mechanism.

In accordance with the present invention, there is provided a keyboard musical instrument comprising: a plurality of keys turnable along trajectories between respective rest positions and respective end positions; a plurality of key sensors respectively monitoring the plurality of keys, and respectively producing key status signals each representative of current key status of associated one of the plurality of key sensors; a plurality of first resilient members respectively associated with the plurality of keys so as to urge the associated keys toward the rest positions; a plurality of second resilient members respectively associated with the plurality of keys so as to urge the associated keys toward the end positions, a first resilient force of each of the plurality of second resilient members being balanced with a second resilient force of associated one of the plurality of first resilient members at the rest position of associated one of the plurality of keys; a plurality of key actuators generating forces exerted on the plurality of keys, respectively, so as to build up resistances to key motions from the rest positions toward the end positions; and a controller connected to the plurality of actuators, and responsive to the key status signals so as to change each resistance depending upon the current key status of associated one of the plurality of keys on the trajectory.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
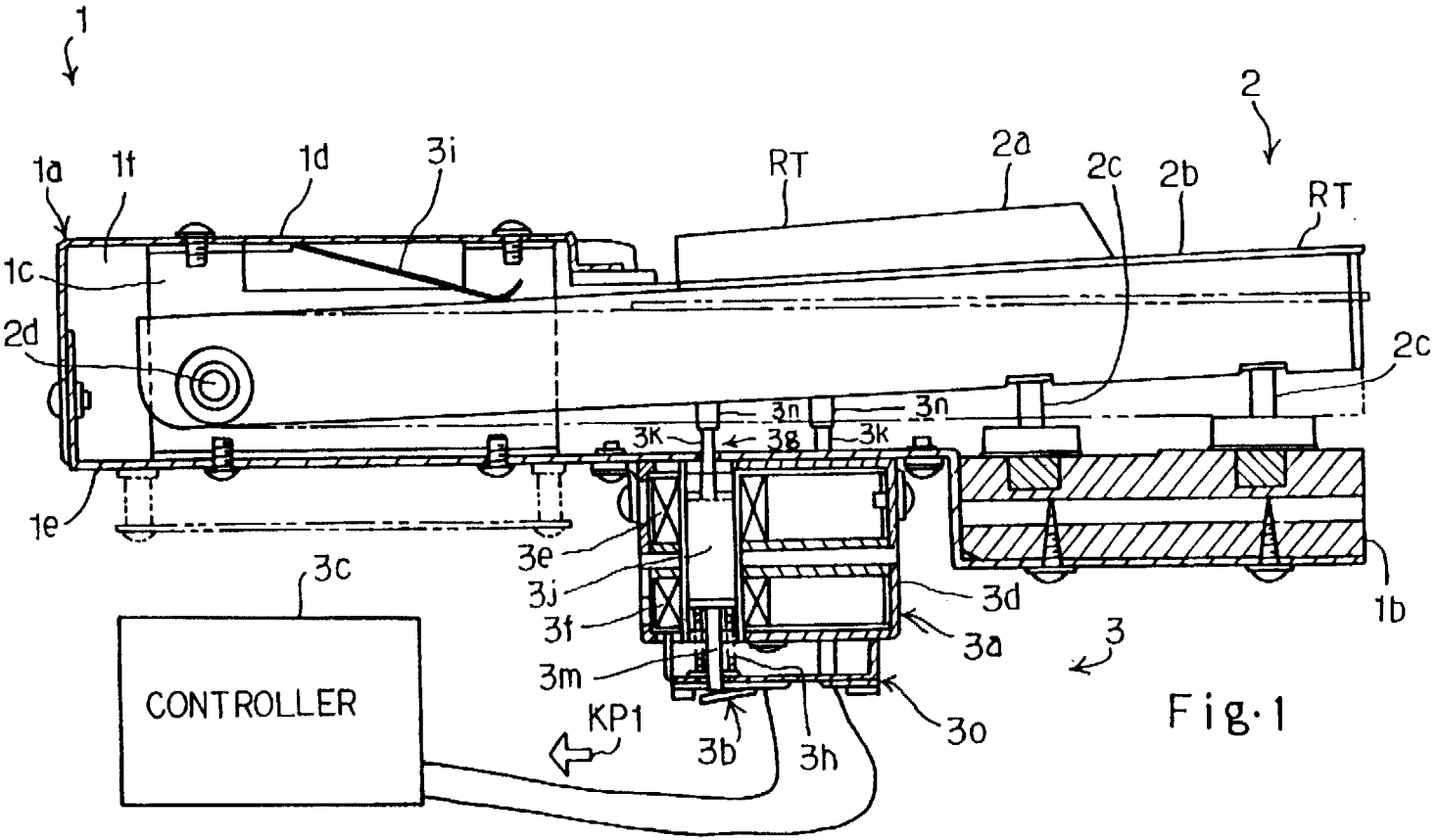
FIG. 1 is a side view showing essential parts of a keyboard musical instrument according to the present invention.

Referring first to FIG. 1 of the drawings, a keyboard musical instrument embodying the present invention largely comprises a case 1, a keyboard 2 and an electronic controlling system 3. The electronic controlling system 3 serves as an electromagnetic key touch generator and an automatic player. The electromagnetic key touch generator imparts a piano-like key touch to a player, and the automatic player drives the keyboard 2 so as to play a tune without a fingering. In the following description, term "front" is indicative of a position closer to a player sitting in front of the keyboard 2 than "rear", and term "lateral" means a direction perpendicular to a line between the front and the rear.

The case 1 includes a frame structure 1*a* for supporting the keyboard 2 and a stationary board member 1*b* attached to the frame structure 1*a* under the keyboard 2 and a supporting post member 1*c* fixed to a rear end portion of the frame structure 1*a*. A relatively short L-letter shaped member 1*d* and a relatively long L-letter shaped member 1*e* are bolted to each other, and a pocket 1*f* is defined between the relatively short L-letter shaped member 1*d* and the relatively long L-letter shaped member 1*e*. The supporting post member 1*c* is accommodated in the pocket 1*f*, and is bolted to the relatively short L-letter shaped member 1*d* and the relatively long L-letter shaped member 1*e*. The relatively long L-letter shaped member 1*e* projects over the front end of the relatively short L-letter shaped member 1*d*, and the stationary board member 1*b* is bolted to the front end portion of the relatively long L-letter shaped member 1*e*.

The keyboard 2 has a plurality of black keys 2*a* turnably supported by the supporting post member 1*c* and a plurality of white keys 2*b* also turnably supported by the supporting post member 1*c*. Although the rear end portions of the black/white keys 2*a*/2*b* are in the pocket 1*f*, the front end portions of the black/white keys 2*a*/2*b* project from the pocket 1*f*, and a player selectively depresses the front end portions of the black/white keys 2*a*/2*b*. Front pins 2*c* are attached to the upper surface of the stationary board member 1*b*, and are inserted into the holes formed in the back/white keys 2*a*/2*b*. The front pins 2*c* prohibit the black/white keys from lateral movement, and, for this reason, the black/white keys 2*a*/2*b* is moved along respective trajectories between rest positions and end positions without an interruption. The black/white keys 2*a*/2*b* are connected to the supporting post member 1*c* by means of pin members 2*d*, and are turnable around the pin members 2*d*.

The electronic controlling system 3 includes a plurality of bi-directionally solenoid operated key actuators 3*a* shared between the electromagnetic key touch generator and the automatic player, a plurality of key sensors 3*b* used for the automatic player and a controller 3*c* shared between the electromagnetic key touch generator and the automatic player.

The plurality of bi-directionally solenoid-operated key actuators 3*a* are provided for the black/white keys 2*a*/2*b*, respectively. A yoke unit 3*d* is elongated in the lateral direction, and is shared between the plurality of bi-directionally solenoid-operated key actuators 3*a*. The yoke unit 3*d* is fixed to the lower surface of the relatively long L-shaped member 1*e*.

A plurality of pairs of solenoid coils 3*e*/3*f* are accommodated in the yoke unit 3*d*, and a plurality of plungers 3*g* are slidably inserted in the yoke unit 3*d*. The solenoid coils 3*e* upwardly urge the associated plungers 3*g*, and the solenoid coils 3*f* downwardly urge the associated plungers 3*g*. Thus, the plungers 3*g* are bi-directionally driven by the pairs of solenoids 3*e*/3*f*, respectively. The pairs of solenoid coils 3*e*/3*f* are arranged in a staggered manner, and, for this reason, each solenoid coil 3*e*/3*f* occupies a space twice as wide as the black/white key 2*a*/2*b*.

Coil springs 3*h* respectively urges the plungers 3*g* so as to upwardly project from the yoke unit 3*d*. As a result, the leading end portions of the plungers 3*g* are held in contact with the lower surfaces of the black/white keys 2*a*/2*b*, respectively.

The electronic controlling system 3 further includes a plurality of leaf spring members 3*i* respectively associated with the black/white keys 2*a*/2*b*. The leaf spring members 3*i* form parts of the electromagnetic key together with the solenoid-operated key actuators 3*a* and the coil springs 3*h*.

The leaf spring members 3*i* downwardly urge the black/white keys 2*a*/2*b*, and causes the black/white keys 2*a*/2*b* and the associated plungers 3*g* to be held in contact with each other. The resilient force of the coil spring 3*h* is balanced with the resilient force of the leaf spring member 3*i* at the rest position RT of the associated black/white key 2*a*/2*b*, and the coil spring 3*h* and the leaf spring member 3*i* are still resiliently deformed.

When the black/white key 2*a*/2*b* is moved between the rest position and the end position, the leaf spring member 3*i* is continuously held in contact with the upper surface of the black/white key 2*a*/2*b*, and changes the contact point on the upper surface of the black/white key 2*a*/2*b*, because the leaf spring member 3*i* is slidable on the upper surface. For this reason, a complicated joint member such as a flexible coupling is not required for the keyboard musical instrument according to the present invention.

A lubricating tape may be bonded to the upper surface of the black/white key 2*a*/2*b* so as to make the sliding motion of the leaf spring member 3*i* smooth.

Moreover, the leaf spring member 3*i* is hardly worn away, because the leaf spring member 3*i* can smoothly slide on the upper surface. Thus, the electromagnetic key touch generator is simple and durable.

The leaf spring members 3*i* and the solenoid-operated key actuators 3*a* are easily assembled with the keyboard 2, because the resilient forces regulate the black/white keys 2*a*/2*b* to the rest positions.

Each of the plungers 3*g* has a thick portion 3*j*, an upper thin portion 3*k* upwardly projecting from the thick portion 3*j* and a lower thin portion 3*m* downwardly projecting from the thick portion 3*j*. The upper thin portion 3*k* and the lower thin portion 3*m* project from the yoke unit 3*d*, and a cushion member 3*n* is attached to the upper thin portion 3*k*. For this reason, the upper thin portion 3*k* is held in contact with the lower surface of the associated black/white key 2*a*/2*b* through the cushion member 3*n*.

On the other hand, the lower thin portion 3*m* projects into an inner space defined by a lower case member 3*o*. The key sensors 3*b* are placed in the lower case member 3*o*, and monitor the lower thin portions 3*m* of the associated plungers 3*g*.

Figure 2:
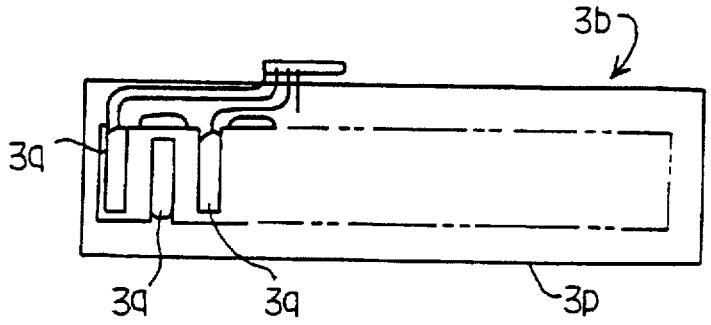
FIG. 2 is a plan view showing a key sensor incorporated in the keyboard musical instrument.

Each of the key sensors 3*b* includes an elastic plate member 3*p* and a plurality of strain gauges 3*q* attached to the elastic plate member 3*p* at intervals as shown in FIG. 2. One end portion of the elastic plate member 3*p* is fixed to the lower surface of the lower case member 3*o*, and the lower thin portion 3*m* urges the other end of the elastic plate member 3*p*. Thus, a current position of the plunger 3*g* is converted through the deformation of the elastic plate member 3*p* to a key position signal KP1, and the key position signal KP1 is supplied to the controller 3*c*.

Figure 3:
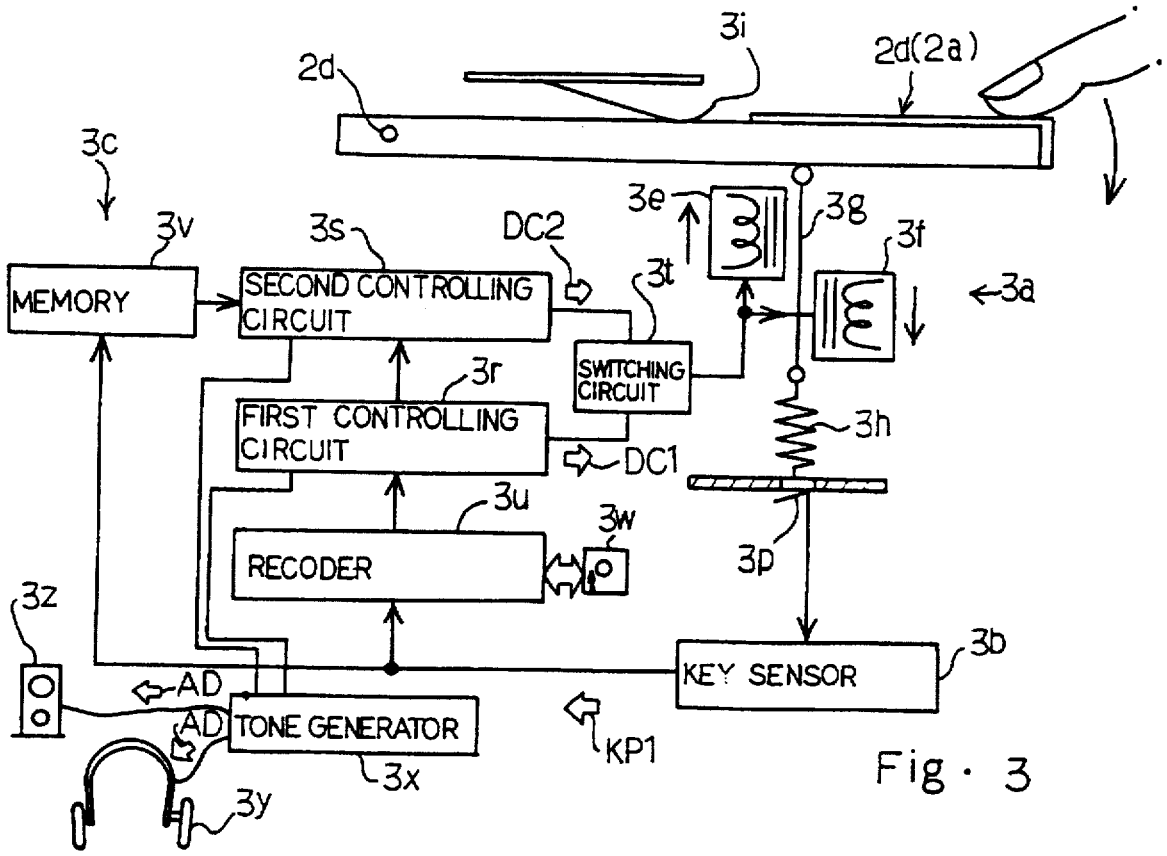
FIG. 3 is a block diagram showing the circuit arrangement of a controller incorporated in the keyboard musical instrument.

The controller 3*c* is illustrated in detail in FIG. 3. The controller 3*c* includes a first controlling circuit 3*r* of the automatic player, a second controlling circuit 3*s* of the electromagnetic key touch generator and a switching circuit 3*t* connected between the first and second controlling circuits 3*r*/3*s* and the solenoid-operated key actuator 3*a*. When the solenoid coil 3*f* is energized, the plunger 3*g* is pulled down, and the associated black/white key 2*a*/2*b* is moved from the rest position to the end position. On the other hand, when the solenoid coil 3*e* is energized, the plunger 3*g* upwardly pushes the black/white key 2*a*/2*b*, and builds up resistance to the motion of the black/white key 2*a*/2*b*.

As described hereinbefore, the leaf spring member 3*i* is balanced with the coil spring 3*h* at the rest position of the associated black/white key 2*a*/2*b*. The solenoid coil 3*f* is expected to cancel the resilient force of the coil spring 3*h*, and the solenoid coil 3e gradually recovers the resilient force of the coil spring 3h. For this reason, the electromagnetic force to be required is not so large as the electromagnetic force of the second prior art. The solenoid coils 3e/3f are so compact that they are easily installed in the narrow space under the keyboard 2.

While a player is playing a tune, each of the key sensors 3b monitors the associated black/white key 2a/2b, and produces the key position signal KP1 representative of the current key position. When a black/white key 2a/2b is depressed and, thereafter, released, the black/white key 2a/2b changes the current key position, and the key position signal KP1 indicates the change of the current key position. The key position signals KP1 are supplied to a recorder 3u and a memory 3v.

The recorder 3u produces a series of music data codes representative of the performance from the key position signals KP1, and the series of music data codes are memorized in a suitable memory such as a floppy disk 3w.

A tone generator 3x is connected to the first controlling circuit 3r, and a head-phone 3y and a speaker system 3z are connected to the tone generator 3x. While the performance is being reproduced, the music data codes are supplied from the floppy disk 3w through the recorder 3u to the first controlling circuit 3r, and the first controlling circuit 3r controls both of the solenoid-operated key actuators 3a and the tone generator 3x. The tone generator 3x produces an audio signal AD from the music data codes, and supplies the audio signal AD to the head-phone 3y and/or the speaker system 3z so as to reproduce the performance.

On the other hand, the memory 3v stores a key-touch table where a series of key touch data are stored in the key-touch table for each of the black/white keys 2a/2b. The series of key touch data are representative of the resistance to be applied to the black/white key 2a/2b, and the resistance varies together with the current key position. When a black/white key 2a/2b is depressed, the series of key touch data are sequentially read out from the memory 3v depending upon the current key position KP1 represented by the key position signal KP1, and are sequentially supplied to the second controlling circuit 3s. Thus, the key position signal KP1 is used as a kind of address signal in the electromagnetic key touch generator.

The keyboard musical instrument behaves as follows. When a user requests the keyboard musical instrument to serve as the automatic player, the switching circuit 3t connects the first controlling circuit 3r to the solenoid-operated key actuators 3a, and the music data codes are read out from the floppy disk 3w to the first controlling circuit 3r. The first controlling circuit 3r sequentially supplies driving current signals DC1 to the solenoid-operated key actuators 3a, and transfers the music data codes to the tone generator 3x.

Assuming now one of the music data codes represents a black/white key 2a/2b to be moved from the rest position to the end position. The first controlling circuit 3r supplies the driving current signal DC1 to the solenoid coil 3f of the associated solenoid-operated key actuator 3a, and the solenoid coil 3f is energized. Then, the plunger 3g is pushed down, and the leaf spring member 3i downwardly presses the black/white key 2a/2b. As a result, the black/white key 2a/2b is moved from the rest position to the end position as if the player depresses it. The first controlling circuit 3r further transfers the music data code to the tone generator 3x, and the tone generator 3x causes the head-phone 3y and/or the speaker system 3z to start an electronic sound with the note assigned to the black/white key 2a/2b.

Subsequently, the first controlling circuit 3r is assumed to receive another music data code representative of the key motion from the end position to the rest position. The first controlling circuit 3r supplies the driving current signal DC1 to the solenoid coil 3e of the associated solenoid-operated key actuator 3a. The solenoid coil 3e is energized so as to upwardly project the plunger 3g, and pushes the associated black/white key 2a/2b toward the rest position. Then, the black/white key 2a/2b is moved toward the rest position against the resilient force of the leaf spring member 3i, and finally reaches the rest position. The first controlling circuit 3r further transfers the music data code to the tone generator 3x, and the tone generator 3x terminates the audio signal AD. Then, the electronic sound is extinguished.

Description is hereinbelow made on the behavior as the electromagnetic key touch generator. The switching circuit 3t connects the second controlling circuit 3s to the solenoid-operated key actuators 3a.

A black/white key 2a/2b is assumed to be depressed by a player during a performance. The black/white key 2a/2b pushes down the plunger 3g, and the plunger 3g deforms the resilient plate 3p of the associated key sensor 3b. The key sensor 3b changes the value of the key position signal KP1 depending upon the current key position of the black/white key 2a/2b, and the key position signal KP1 is supplied to the memory 3v.

The memory 3v sequentially supplies the key touch data to the second controlling circuit 3s, and the second controlling circuit 3s supplies a driving current signal DC2 to the solenoid coil 3e of the associated solenoid-operated key actuator 3a. The solenoid coil 3e pushes up the plunger 3g, and the plunger 3g builds up resistance to the black/white key 2a/2b. The player feels a kind of load at his finger as if the black/white key 2a/2b actuates a key action mechanism of an acoustic piano.

The magnitude of the driving current signal DC2 varies together with the current key position, and causes the load at the player's finger to vary as similar to the load on the key of the acoustic piano.

The second controlling circuit 3s may produce the music data code representative of the key motion from the rest position to the end position so as to transfer it to the tone generator 3x.

While the player is performing a tune, the second controlling circuit 3s selectively supplies the driving current signals DC2 to the solenoid-operated key actuators 3a, and the solenoid-operated key actuators 3a generate the piano key touch.

In this instance, the coil springs 3h and the leaf spring members 3i serve as a plurality of first resilient members and a plurality of second resilient members, respectively.

As will be appreciated from the foregoing description, the leaf spring members 3i are slidably held in contact with the upper surfaces of the associated black/white keys 2a/2b, and are hardly worn away. This results in that the keyboard musical instrument according to the present invention is durable and simple in structure. Moreover, the solenoid coils 3e/3f are only expected to cancel or recover the resilient force of the coil spring 3h, and are compact and small in electric power consumption.

Second Embodiment

Figure 4:
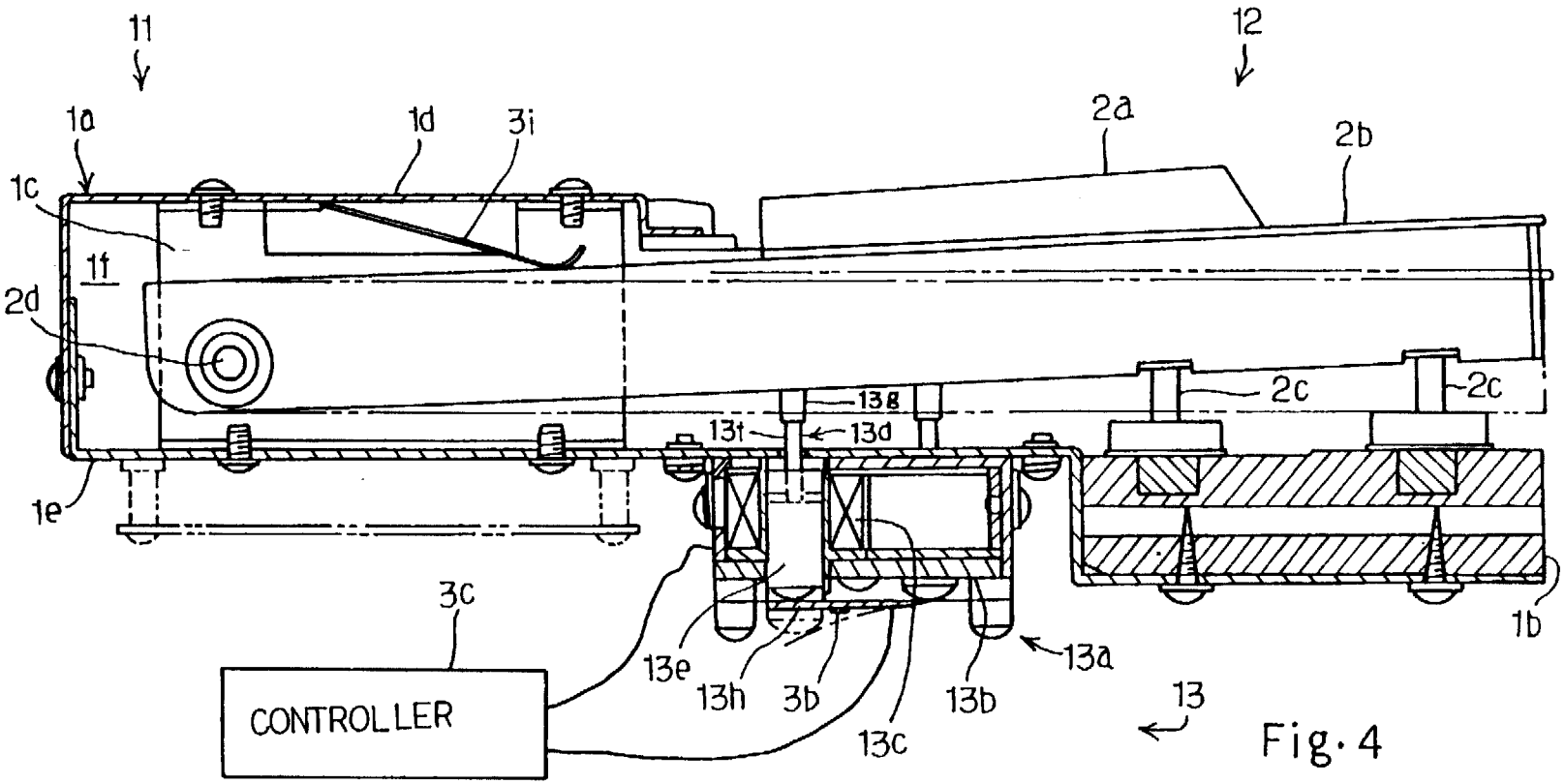
FIG. 4 is a side view showing essential parts of another keyboard musical instrument according to the present invention.

FIG. 4 illustrates another keyboard musical instrument embodying the present invention. The keyboard musical instrument is also comprises a case 11, a keyboard 12 and an electronic controlling system 13. The case 11 and the keyboard 12 are similar to those of the first embodiment, and parts are labeled with the same references designating the corresponding parts of the first embodiment without detailed description.

The electronic controlling system 13 is similar to that of the first embodiment except for the solenoid-operated key actuators 13*a*, and the other component members are labeled with the same references designating the corresponding parts of the first embodiment.

The solenoid-operated key actuator 13*a* includes a yoke unit 13*b* laterally elongated under the keyboard 12, a plurality of solenoid coils 13*c* arranged in staggered manner and a plurality of plungers 13*d* driven by the solenoid coils 13*c*. The solenoid coils 13*c* is respectively associated with the black/white keys 2*a*/2*b*, and each of the plungers 13*d* is associated with only one solenoid coil 13*c*. For this reason, the solenoid coil 13*c* forces the associated plunger 13*d* to be downwardly moved, and allows the associated black/white key 2*a*/2*b* to be pushed down by the leaf spring member 3*i*.

The plunger has a thick portion 13*e* slidably supported by the yoke unit 13*b* and a thin portion 13*f* projecting from the thick portion 13*e*, and a cushion member 13*g* is attached to the leading end portion of the thin portion 13*f*. On the other hand, the thick portion 13*e* is held in contact with a leaf spring member 13*h*, and the leaf spring member 13*h* is fixed to the lower surface of the yoke unit 13*b*. The leaf spring member 13*h* upwardly urges the plunger 13*d*, and presses the cushion member 13*g* to the lower surface of the associated black/white key 2*a*/2*b*. In this instance, the solenoid-operated key actuator 13*a* is shared between the automatic player and the electromagnetic key touch generator.

The resilient force of the leaf spring member 13*h* is balanced with the resilient force of the leaf spring member 3*i* at the rest position of the associated black/white key 2*a*/2*b*, and the solenoid coil 13*c* is only expected to cancel the resilient force of the leaf spring member 13*h*.

Figure 5:
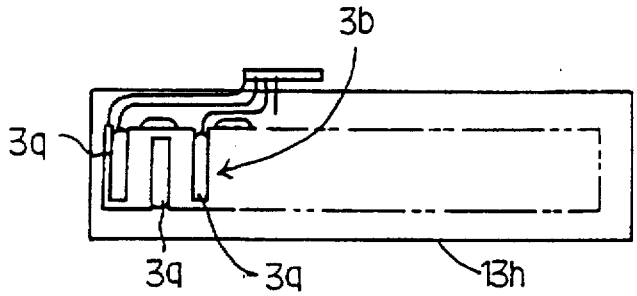
FIG. 5 is a plan view showing a key sensor incorporated in the keyboard musical instrument.

As shown in FIG. 5, the strain gauges 3*q* are attached to the leaf spring member 13*h*, and form in combination the key sensor 3*b* for one of the black/white keys 2*a*/2*b*. While a black/white key 2*a*/2*b* is being depressed from the rest position toward the end portion, the plunger 13*d* is downwardly forced, and deforms the leaf spring member 13*h*. The deformation of the leaf spring member 13*h* affects the strain gauges 3*q*, and the key sensor 3*b* changes the value of the key position signal KP1 representative of the current key position of the associated black/white key 2*a*/2*b*.

Figure 6:
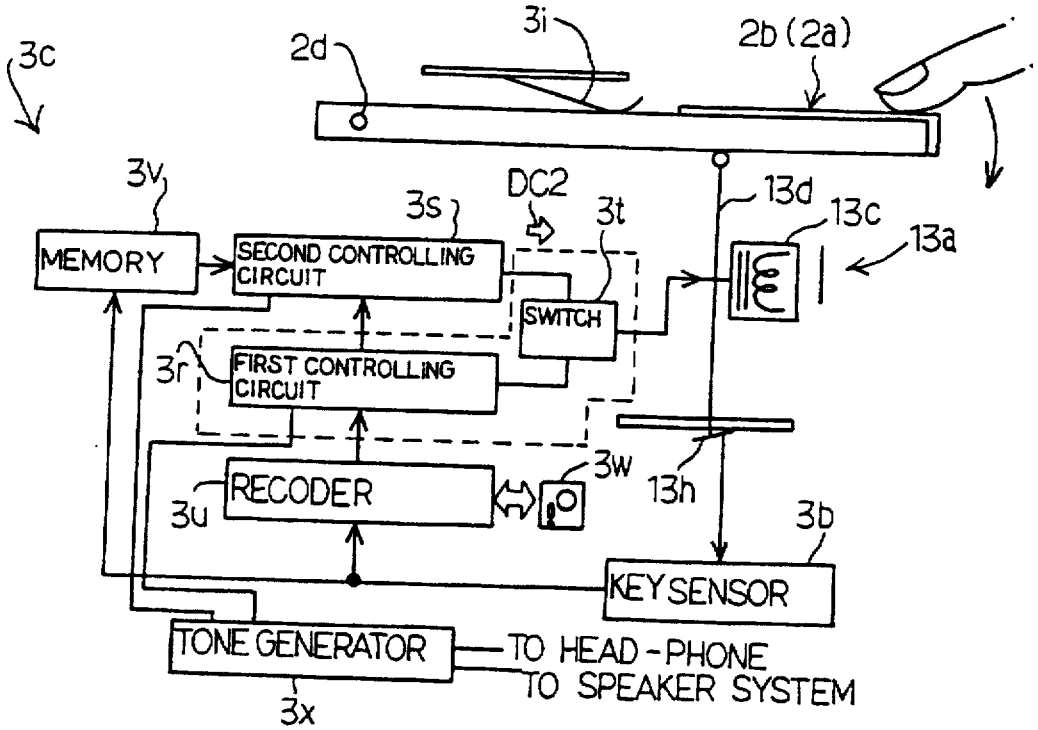
FIG. 6 is a block diagram showing the circuit arrangement of a controller incorporated in the keyboard musical instrument.

The controller 3*c* is similar in circuit arrangement to that of the first embodiment. The components circuits of the controller 3*c* is illustrated in FIG. 6, and are labeled with the same references designating corresponding components of the first embodiment.

When a user requests the keyboard musical instrument to serve as the automatic player, the electronic controlling system 13 behaves as similar to the first embodiment except for the release of the black/white key 2*a*/2*b*. In the first embodiment, the first controlling circuit 3*r* energizes the solenoid coil 3*e* so as to regulate the resilient force of the coil spring 3*h*. However, the first controlling circuit 3*r* of the second embodiment merely deenergizes the solenoid coil 13*c* so that the leaf spring member 13*h* causes the black/white key 2*a*/2*b* to return to the rest position.

On the other hand, when the user requests the keyboard musical instrument to serve as the electromagnetic key touch generator. The switching circuit 3*t* connects the second controlling circuit 3*s* to the solenoid-operated key actuators 13*a*.

A black/white key 2*a*/2*b* is assumed to be depressed by a player during a performance. The black/white key 2*a*/2*b* pushes down the plunger 13*d*, and the plunger 13*d* deforms the leaf spring member 13*h*. The key sensor 3*b* changes the value of the key position signal KP1 depending upon the current key position of the black/white key 2*a*/2*b*, and the key position signal KP1 is supplied to the memory 3*v*.

The memory 3*v* sequentially supplies the key touch data to the second controlling circuit 3*s*, and the second controlling circuit 3*s* supplies a driving current signal DC2 to the solenoid coil 13*c* of the associated solenoid-operated key actuator 13*a*. The solenoid coil 13*c* pushes up the plunger 13*d*, and the plunger 13*d* builds up resistance to the black/white key 2*a*/2*b*. The player feels a kind of load at his finger as if the black/white key 2*a*/2*b* actuates a key action mechanism of an acoustic piano.

The magnitude of the driving current signal DC2 varies together with the current key position, and causes the load at the player's finger to vary as similar to the load on the key of the acoustic piano.

The keyboard musical instrument implementing the second embodiment achieves all the advantages of the first embodiment. The solenoid-operated key actuator 13*a* has only one solenoid coil 13*c*, and the keyboard musical instrument is reduced in production cost.

Although particular embodiments of the present invention have been shown and described, it will be obvious to those skilled in the art that various changes and modifications may be made without departing from the spirit and scope of the present invention.

For example, the recorder 3*u*, the first controlling circuit 3*r* and the switching circuit 3*t* may be deleted from the controller 3*c* so as to serve as an electromagnetic key touch generator. The tone generator 3*x* may be further deleted from the controller 3*c*.

The plunger may be connected to the black/white key 2*a*/2*b* by means of a pin member. The solenoid-operated key actuator may be provided over the keyboard so as to push down the black/white key 2*a*/2*b*.

The key sensor 3*b* may be implemented by non-contact sensor such as a photo-coupler. The coil spring 3*h* or the leaf spring member 13*h* may be directly held in contact with the black/white key 2*a*/2*b*.

The strain gauges may be attached to the leaf spring members 3*i*.

When the electronic controlling system 3/13 may be incorporated in an acoustic piano so as to behave as an automatic player.

What is claimed is:

1. A keyboard musical instrument comprising:

a plurality of keys turnable along trajectories between respective rest positions and respective end positions;

a plurality of key sensors respectively monitoring said plurality of keys, and respectively producing key status signals each representative of current key status of associated one of said plurality of key sensors;

a plurality of first resilient members respectively associated with said plurality of keys so as to urge the associated keys toward said rest positions;

a plurality of second resilient members respectively associated with said plurality of keys so as to urge the associated keys toward said end positions, a first resilient force of each of said plurality of second resilient members being balanced with a second resilient force of associated one of said plurality of first resilient members at the rest position of associated one of said plurality of keys;

a plurality of key actuators generating forces exerted on said plurality of keys, respectively, so as to build up resistances to key motions from said rest positions toward said end positions; and a controller connected to said plurality of actuators, and responsive to said key status signals so as to change each resistance depending upon said current key status of associated one of said plurality of keys on the trajectory.

2. The keyboard musical instrument as set forth in claim 1, in which said plurality of key sensors detect current positions of the associated keys on said trajectories, respectively, so that said key status signals respectively represent said current positions.

3. The keyboard musical instrument as set forth in claim 2, in which said plurality of key sensors are implemented by strain gauges attached to said plurality of first resilient members.

4. The keyboard musical instrument as set forth in claim 2, in which said controller has a table storing a plurality of sets of key touch data for said plurality of keys, and each set of key touch data represents a resistance to be applied to associated one of said plurality of keys, said resistance being variable depending upon the current position of associated one of said plurality of keys.

5. The keyboard musical instrument as set forth in claim 1, in which each of said plurality of key actuators is implemented by a solenoid-operated key actuator having a plunger held in contact with associated one of said plurality of keys.

6. The keyboard musical instrument as set forth in claim 5, in which said solenoid-operated key actuator has a first solenoid coil and a second solenoid coil, said first solenoid coil urging said plunger in a direction where said associated one of said plurality of keys is moved from said rest position toward said end position, said second solenoid coil urging said plunger in a direction where said associated one of said plurality of keys is moved from said end portion toward said rest position.

7. The keyboard musical instrument as set forth in claim 6, in which said controller further includes a controlling circuit responsive to music data codes so as to selectively energize the first solenoid coil of said plurality of key actuators and the second solenoid coils of said plurality of key actuators, thereby moving said plurality of keys for reproducing a performance without a fingering on said plurality of keys.

8. The keyboard musical instrument as set forth in claim 5, in which said solenoid-operated key actuator has a single solenoid coil, and said single solenoid coil urges said plunger in a direction where said associated one of said plurality of keys is moved from said rest position toward said end position.

9. The keyboard musical instrument as set forth in claim 5, in which each of said plurality of first resilient members is implemented by a coil spring held in contact with associated one of said plurality of keys at a leading end thereof for urging said plunger in a direction where said associated one of said plurality of keys is moved from said end position toward said rest position, and each of said plurality of second resilient members is implemented by a leaf spring member urging said associated one of said plurality of keys in a direction from said rest position toward said end position.

10. The keyboard musical instrument as set forth in claim 9, in which each of said plurality of first resilient members is implemented by a first leaf spring member held in contact with one end of said plunger for urging said plunger in a direction where associated one of said plurality of keys is moved from said end position toward said rest position, and each of said plurality of second resilient members is implemented by a second leaf spring member held in contact with the other end of said plunger for urging said plunger in a direction where said associated one of said plurality of keys is moved from said rest position toward said end position.

* * * * *